US009320393B2

(12) United States Patent
Geels et al.

(10) Patent No.: US 9,320,393 B2
(45) Date of Patent: Apr. 26, 2016

(54) STRUCTURAL WALL DESIGN OF A COMPOSITE BATHING VESSEL

(75) Inventors: Michael Glenn Geels, Jackson, TN (US); Scott Kapelanski, Howell, MI (US); Hyun Moon, Bloomfield Hills, MI (US)

(73) Assignee: Delta Faucet Company, Indianapolis, IN (US)

( * ) Notice: Subject to any disclaimer, the term of this patent is extended or adjusted under 35 U.S.C. 154(b) by 301 days.

(21) Appl. No.: 13/883,078

(22) PCT Filed: Sep. 2, 2011

(86) PCT No.: PCT/US2011/050372

§ 371 (c)(1), (2), (4) Date: Aug. 21, 2013

(87) PCT Pub. No.: WO2012/067700

PCT Pub. Date: May 24, 2012

(65) Prior Publication Data

US 2014/0020172 A1 Jan. 23, 2014

Related U.S. Application Data

(60) Provisional application No. 61/413,575, filed on Nov. 15, 2010.

(51) Int. Cl.

| | |
|---|---|
| ***A47K 3/04*** | (2006.01) |
| ***A47K 3/02*** | (2006.01) |
| ***A47K 3/30*** | (2006.01) |
| ***B05D 3/12*** | (2006.01) |
| ***A47K 3/16*** | (2006.01) |

(52) U.S. Cl.

CPC ... *A47K 3/04* (2013.01); *A47K 3/02* (2013.01); *A47K 3/16* (2013.01); *A47K 3/30* (2013.01); *B05D 3/12* (2013.01); *Y10T 29/49* (2015.01); *Y10T 29/49826* (2015.01)

(58) Field of Classification Search

CPC ..... A47K 3/1605; A47K 3/16; A47K 3/08; A47K 3/20; A47K 3/283; A47K 3/284

USPC ..... 4/614, 612, 584, 593, 592

See application file for complete search history.

(56) References Cited

U.S. PATENT DOCUMENTS

| | | | | |
|---|---|---|---|---|
| D336,949 | S | 6/1993 | Clark et al. | |
| 5,778,463 | A | 7/1998 | Teckchandani et al. | |
| 2004/0146714 | A1 | 7/2004 | McCollum et al. | |
| 2005/0276941 | A1 * | 12/2005 | Kapelanski et al. | 428/35.7 |
| 2005/0281997 | A1 * | 12/2005 | Grah | 428/215 |
| 2010/0212083 | A1 | 8/2010 | Stafford | |

OTHER PUBLICATIONS

PCT Search Report from corresponding int'l application PCT/US11/50372.

* cited by examiner

*Primary Examiner* — Janie Loeppke

(74) *Attorney, Agent, or Firm* — Carlson, Gaskey & Olds, PC

(57) ABSTRACT

A bathing vessel has a first and a second sandwiched wall, each wall having a first layer of polyurethane material, a second layer of polyurethane material attached to the first layer, a third layer of acrylonitrile butadiene styrene (ABS) material attached to the second layer, and a fourth layer of acrylic material attached to the third layer. A load element is disposed across and is integral with the first and second sandwiched walls. The load element distributes a load on one wall to an other wall and is visible to users of the bathing vessel. The load element is also a design element.

24 Claims, 2 Drawing Sheets

STRUCTURAL WALL DESIGN OF A COMPOSITE BATHING VESSEL

RELATED APPLICATION

This application claims priority to U.S. Provisional Application No. 61/413,575, which was filed Nov. 15, 2010.

TECHNICAL FIELD

This disclosure relates to composite bathing vessels.

BACKGROUND

Bathing vessels such as showers and bathtubs have surrounds that are subject to stresses. The walls may support grab bars and towel bars, and users may interact with the walls of the surrounds by stressing them.

Bathing vessels may be manufactured from a variety of different materials, such as plastic materials. Plastic bathing vessels, however, must meet certain minimum performance requirements. For instance, the American National Standards Institute (ANSI) sets forth minimum physical requirements and testing methods for plastic bathtub and shower units. A bathing vessel that meets the requirements is approved for use in homes, buildings or other structures as a plumbing fixture.

SUMMARY

According to an embodiment shown herein, a bathing vessel has a first and a second sandwiched wall, each wall having a first layer of polyurethane material, a second layer of polyurethane material attached to the first layer, a third layer of acrylonitrile butadiene styrene (ABS) material attached to the second layer, and a fourth layer of acrylic material attached to the third layer. A load element is disposed across and is integral with the first and second sandwiched walls. The load element distributes a load on one wall to an other wall and is visible to users of the bathing vessel. The load element is also a design element.

According to a further embodiment shown herein, a bathing vessel has a first and a second sandwiched wall, each wall having a first layer of polyurethane material, a second layer of polyurethane material attached to the first layer, and a third layer of acrylonitrile butadiene styrene (ABS) material attached to the second layer. A load element is disposed across and is integral with the first and second sandwiched walls. The load element distributes a load on one wall to an other wall and is visible to users of the bathing vessel. The load element is also a design element.

According to a further embodiment shown herein, a method for constructing a bathing vessel includes the steps of: choosing a layered material defining a first wall and a second wall, the layered material having a first layer of polyurethane material, a second layer of polyurethane material attached to the first layer, and a third layer of acrylonitrile butadiene styrene (ABS) material attached to the second layer; determining a load to be distributed across the first wall and the second wall; forming a load element that is integral with and in the first and second walls that is visible to users, and crosses the first wall and the second wall to distribute the load across the first and the second wall; and, making the load element a design element.

According to a still further embodiment shown herein, a bathing vessel has a first and a second sandwiched wall and a load element that is integral with and disposed across said first and second sandwiched walls that distributes a load on one wall to the other wall and is visible to users of said bathing vessel wherein said load element is also a design element.

These and other features of the present invention can be best understood from the following specification and drawings, the following of which is a brief description.

DETAILED DESCRIPTION

Figure 1:
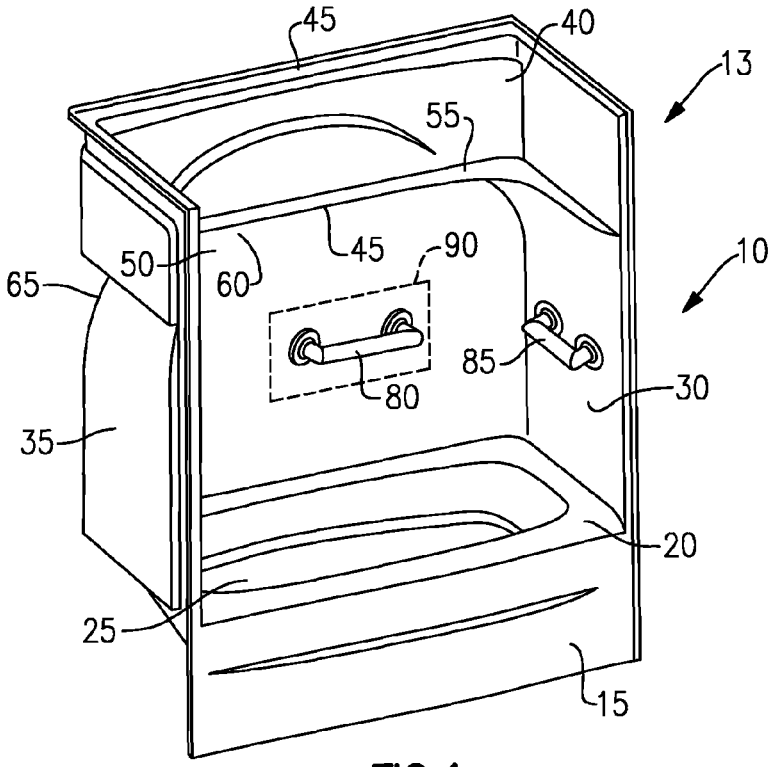
FIG. 1 is a perspective view of a one piece bathing vessel.
Figure 2:
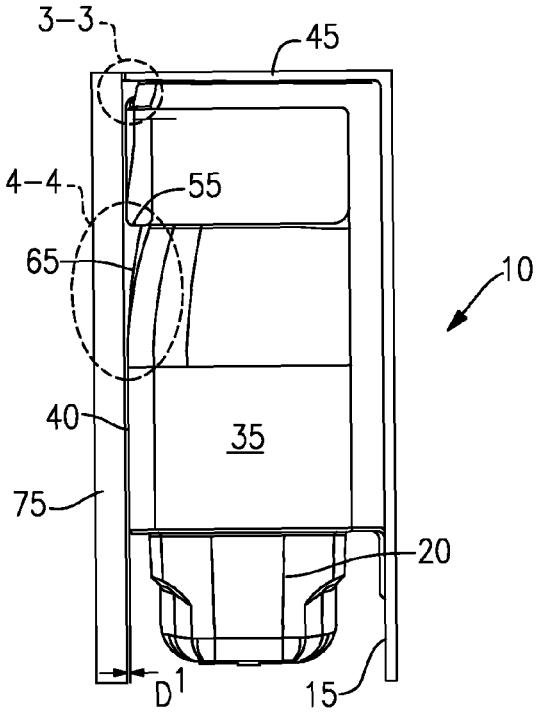
FIG. 2 is a side view of bathing vessel of FIG. 1.
Figure 3:
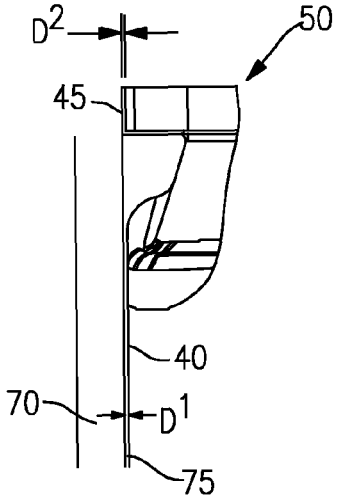
FIG. 3 is a detailed view, taken along the lines 3-3 of FIG. 2.

Referring now to FIGS. 1-3, a perspective view of a one-piece bathing vessel 10, including tub 25, a surround 13, a skirt 15 in front of the tub 25, a deck 20 circling a top of the tub, a right sidewall 30 extending upwardly from the deck 20, a left surround wall 35 extending upwardly from the deck 20 and a back wall 40 extending upwardly from the deck 25 and attaching to and integral with the left surround wall 35 and the right surround wall 30. A nailing flange 45 is disposed around the bathing vessel 10 and is used to attach the bathing vessel 10 to a stud wall 70 or an attachment plane 75. A design/load element 50 extends from the left surround wall 35 across the back wall 40 and across to the right side surround wall 30. The curved portion 60 of the design/load element 50 has a back 65. Though a one-piece bathing vessel is shown herein, one of ordinary skill in the art will recognize from the teachings herein, that a one-piece surround made of a side wall(s) and a back wall may also be constructed as taught herein.

Referring to FIGS. 2 and 3, details of the design/load element 50 are shown. But for the design element/load element 50, and the nailing flange 45, the back wall 40 and the right and left surround walls 30, 35 are disposed a distance $D^1$ of 0.05 inches from a stud wall 70 or an attachment plane 75. Some requirements, such as for ANSI, require the sidewalls 30, 35 or back wall 40 not to deflect more than 0.25 inch. By keeping these walls less than 0.25 inch away from the stud wall 70 or attachment plane 75, the distance these walls can deflect is less than 0.25 inch and the requirements are then met. Because of the flexibility of the walls 35, 40, 30, given the material 57, as will be discussed infra, uses, the $D^1$ should be less than or equal to 0.25 inches. The nailing flange 45 and the sidewalls and back walls 35, 40, 30, each have a thickness $D^2$ of 0.070 inches.

Figure 4:
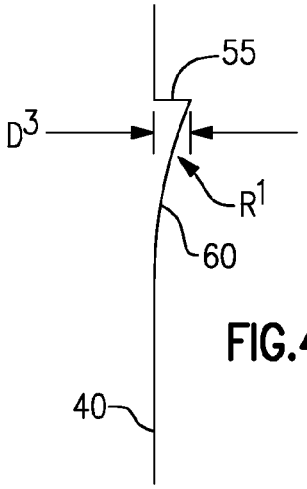
FIG. 4 is a detailed view, taken along the lines 4-4 of FIG. 2.

The design/load element 50 has a ledge extending around the back wall 40 and the side walls 30, 35 and the curved area 60 also extending around the back wall 40 and the side walls 30, 35. As seen in FIG. 4, the design/load element 50 is defined from behind the bathing vessel 10. The curved area 60 helps give the design load element a better aesthetic look and feel to a user. The ledge 55 has a width $D^3$ of 1.69 inches. By creating the ledge and the curved area in conjunction with a material 57 as will be discussed infra, stresses on the back wall 40 and the side walls 30, 35 are absorbed into the design/load element 50 and distributed across the back wall 40 and the side walls 30, 35. As a result, less material 57 may be utilized to effect a cost benefit for the bathing vessel 10. Though a particular design/load element 50 is disclosed herein, other design/load element 50 are contemplated herein.

The ledge 55 and curved area 60 bisect a span of each of the walls to shorten the span of the wall area holding the loads 80, 85 to facilitate increased rigidity while minimizing material requirements.

Figure 5:
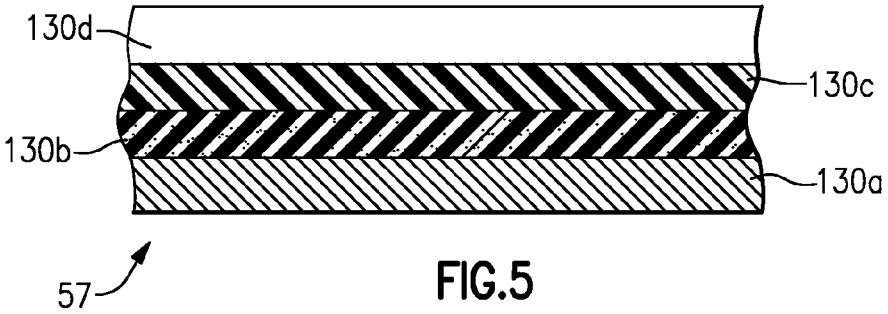
FIG. 5 is side view of the material forming the bathing vessel of FIG. 1.

Referring to FIG. 5, the bathing vessel 10 is made of a material that is flexible yet rigid so that point loads on the walls such as grab bar 80 or grab bar 85 which typically require extensive local reinforcement 90 (see FIG. 1), which may be a metallic panel that may attach to the studs 70, do not require extensive local reinforcement of the back wall 40 or the side walls 30, 35 because the point load is distributed through the design/load element 50 across the sidewalls 30, 35 and the back wall 40.

The material must be flexible and rigid to enable the load to be distributed across the back wall 40, left side wall 35 and the right side wall 30. FIG. 4 shows a cross-section through a portion of one of the walls 35. The walls 35 are a multi-layer structure that generally includes a first layer of polyurethane material 130*a*, a second layer of polyurethane material 130*b*, a layer of acrylonitrile butadiene styrene (ABS) material 130*c*, and a layer of acrylic material 130*d* (collectively layers 130*a-d*), such as polymethylmethacrylate. As shown, the layer of acrylic material 130*d* is a top layer and is exposed for view to a user within the bathing vessel 20. The layers 130*b* and 130*c* are intermediate layers, and the layer 130*a* is a bottommost layer that is generally obscured from view of a user within the bathing vessel 10. Each of the layers 130*a-d* is bonded to its respective neighboring layer or layers. In embodiments, the specific materials and order of the layers 130*a-d* contributes to providing the bathing vessel with a desired degree of strength, such as to meet ANSI requirements.

In embodiments, the layer of acrylic material 130*d* is arranged on the first layer of polyurethane material 130*a*, the layer of acrylonitrile butadiene styrene (ABS) material 130*c* is arranged between the layer of acrylic material 130*d* and the first layer of polyurethane material 130*a*, and the second layer of polyurethane material 130*b* is arranged between the layer of ABS material 130*c* and the first layer of polyurethane material 130*a*. In some examples, additional layers may be arranged among the layers 130*a-d*. In other examples, the walls 35 include only the layers 130*a-d* and are free of other layers, materials, adhesives, or the like.

The thicknesses of the individual layers 130*a-d* is not necessarily shown to scale and may vary, depending on the desired wall strength and location in the wall 35, for example. In embodiments, the ratio of the thickness of the layer of acrylic material 130*d* to the thickness of the layer of ABS material is no greater than 1, to facilitate meeting strength requirements.

In embodiments, the first layer of polyurethane material 130*a*, the second layer of polyurethane material 130*b*, or both, are foamed polyurethane materials. In some examples, the density of the first layer of polyurethane material 130*a* is different than the density of the second layer of polyurethane material 130*b*. For instance, the density of the first layer of polyurethane material 130*a* is greater than the density of the second layer of polyurethane material 130*b*, to facilitate achievement of a desired degree of strength of the walls 35.

In a further example, the second layer of polyurethane material 130*b* is a rigid layer and has a density of 1-10 pounds per cubic foot. The first layer of polyurethane material 130*a* is an elastomeric layer and has a density of between about 25-65 pounds per cubic foot though in some examples approximately 55-65 pounds per cubic foot are used. In one example, the density is approximately 62 pounds per cubic foot.

Figure 6:
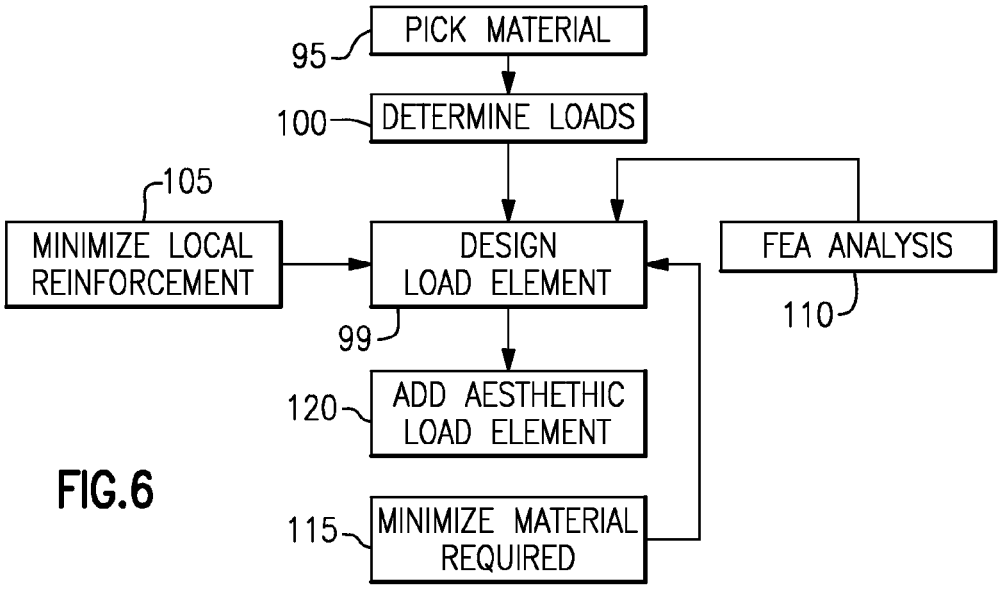
FIG. 6 depicts a method of designing a bathing vessel.

Referring now to FIG. 6, local requirements, such as ANSI standards, may require walls 30, 35, 40, to withstand point or other loads that have heretofore required extensive local reinforcement. If designing or constructing a bathing vessel 10 herein, a designer may choose to use the material 57 herein (step 95). The designer would then design a load element such as ledge 55, taking into account the following variables: finite element analysis or the like how stresses of point loads are distributed around walls 30, 35, 40 in view of a proposed design (step 110); minimizing material 57 required as the design evolves (step 115) and minimizing local reinforcement 90 required (step 105). The designer then provides and aesthetic (step 120), such as curved area 60, to make the bathing vessel attractive to consumers. By understanding that the material helps distribute the point or other loads with the inclusion of a design/load element 50, the designer may include a design/load element 50 that is both aesthetic and provides support for the loads across the walls 30, 35, 40. After designing a design/load element 50, the designer may then opt for smaller local reinforcement, or a thinner material 57.

It is commonly believed and accepted that the load displacement of the surface of the walls 30, 35, 40, of the bathing vessel 10 is a function of the rigidity of the immediate area. However, it has been determined that by using less rigid materials, a load can be distributed throughout the unit by use of a design element that ties the walls together. In other words, a wrap around shelf or other design feature that has continuity across the back wall surface in carrying through the corner radius and onto each sidewall, can distribute the load across the entire unit. By distributing the load across the entire unit, thinner material may be used, allowing weight in material savings.

Furthermore, the embodiments shown utilize design elements to shorten the span of the wall area to facilitate increased rigidity while minimizing material requirements. In addition, the wall design elements use a minimum distance from the stud plane (or installation alcove surface) at key loading points to minimize the maximum deflection of the walls of the bathing vessel.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A bathing vessel, said vessel comprising:

a first and a second sandwiched wall having a first layer of polyurethane material, a second layer of polyurethane material attached to said first layer, a third layer of acrylonitrile butadiene styrene (ABS) material attached to said second layer, and a fourth layer of acrylic material attached to said third layer, a load element disposed across and is integral with said first and second sandwiched walls that distributes a load on one wall to other walls and is visible to users of said bathing vessel wherein said load element is also a design element.

2. The bathing vessel of claim 1 wherein further comprising said load element is a portion attaching perpendicularly at an inner edge thereof and integrally to said first wall and said second wall and passing across a corner between the first wall and second wall, and wherein said portion extends entirely across at least one of said first wall and said second wall.

3. The bathing vessel of claim 2 wherein said load element further comprises a curved area disposed integrally in and extending outwardly from said first wall and said second wall and across a corner between the first wall and second wall, said curved area blending from said first wall and said second wall into an outer edge of said portion.

4. The bathing vessel of claim 1 wherein the first and second walls have an outer surface configured to be visible to users and an inner surface configured to face a wall structure, and further comprising said load element is a curved portion formed in the inner surface and extending outwardly from said first wall and said second wall and across a corner between the first wall and second wall.

5. The bathing vessel of claim 4 further comprising a load disposed in one of said first wall or said second wall, and wherein the load element further comprises a ledge extending about the first and second walls, and wherein the curved portion transitions from a vertical wall surface below the ledge to an outer edge of the ledge.

6. The bathing vessel of claim 1 further comprising a nailing flange disposed across an outer edge of said first wall and said second wall wherein a distance between an outer edge of said nailing flange and a back of said first wall and said second wall is less than or equal to 0.25 inches.

7. The bathing vessel of claim 1 wherein said load element passes across and is integrally attached to a corner between said first and second sandwiched walls.

8. The bathing vessel of claim 1 wherein said load element is horizontal.

9. A bathing vessel, said vessel comprising:

a first and a second sandwiched wall having a first layer of polyurethane material, a second layer of polyurethane material attached to said first layer, and a third layer of acrylonitrile butadiene styrene (ABS) material attached to said second layer, a load element that is integral with and disposed across said first and second sandwiched walls that distributes a load on one wall to the other wall and is visible to users of said bathing vessel wherein said load element is also a design element.

10. The bathing vessel of claim 9 wherein further comprising said load element is a portion attaching perpendicularly at an inner edge thereof and integrally to said first wall and said second wall and passing across a corner between the first wall and second wall, and wherein said portion extends entirely across at least one of said first wall and said second wall.

11. The bathing vessel of claim 9 wherein the first and second walls have an outer surface configured to be visible to users and an inner surface configured to face a wall structure, and wherein said load element further comprises a curved portion formed in the inner surface and extending outwardly from said first wall and said second wall and across a corner between the first wall and second wall, and wherein the load element further comprises a ledge extending about the first and second walls, and wherein said curved portion transitions from a vertical wall surface below the ledge to an outer edge of said ledge.

12. The bathing vessel of claim 9 further comprising said load element is a curved area disposed integrally in and extending outwardly from said first wall and said second wall and across a corner between the first wall and second wall.

13. The bathing vessel of claim 9 further comprising a load disposed in one of said first wall or said second wall.

14. The bathing vessel of claim 9 further comprising a nailing flange disposed across an outer edge of said first wall and said second wall wherein a distance between an outer edge of said nailing flange and a back of said first wall and said second wall is less than or equal to 0.25 inches.

15. The bathing vessel of claim 9 wherein said load element passes across and is integrally attached to a corner between said first and second sandwiched walls.

16. The bathing vessel of claim 9 wherein said load element is horizontal.

17. A method for constructing a bathing vessel comprising the steps of:

choosing a layered material defining a first wall and a second wall, the layered material having a first layer of polyurethane material, a second layer of polyurethane material attached to said first layer, and a third layer of acrylonitrile butadiene styrene (ABS) material attached to said second layer, determining a load to be distributed across the first wall and the second wall, forming a load element that is integral with and in said first and second walls that is visible to users, and crosses said first wall and said second wall to distribute said load across said first and said second wall, and making said load element a design element.

18. The method of claim 17 wherein said forming a load element further comprises passing said load element across and integrally attaching said load element to a corner between said first and second sandwiched walls, and wherein said load element extends entirely across at least one of said first wall and said second wall.

19. The method of claim 17 wherein said forming said load element step includes forming said load element as a ledge and a curved portion formed in a wall facing side of the first and second walls, with the ledge extending horizontally across said first and second wall and the curved portion transitioning from a vertical wall surface below the ledge to an outer edge of the ledge.

20. A bathing vessel comprising:

a first wall;

a second wall that faces the first wall;

a third wall that connects the first and second walls, wherein the first, second, and third walls have a multi-layer structure including at least a first layer of polyurethane material, a second layer of polyurethane material attached to said first layer, and a third layer of acrylonitrile butadiene styrene (ABS) material attached to said second layer; and a load element disposed across and integral with the first, second, and third walls that distributes a load on one wall to other walls and is visible to users of the bathing vessel wherein the load element is also a design element.

21. The bathing vessel of claim 20 wherein the first and second walls comprise opposing side walls and the third wall comprises a rear wall connected to the opposing side walls at corners, and wherein the load element extends horizontally across an entirety of the rear wall, across the corners, and horizontally along the opposing side walls.

22. The bathing vessel of claim 20 wherein the multi-layer structure further includes a fourth layer of acrylic material attached to said third layer.

23. The bathing vessel of claim 20 wherein the first, second, and third walls have an outer surface configured to be visible to users and an inner surface configured to face a wall structure, and wherein the load element comprises a curved portion formed in the inner surface.

24. The bathing vessel of claim 23 wherein the load element further comprises a ledge extending about the first, second, and third walls and wherein the curved portion transitions from a vertical wall surface below the ledge to an outer edge of the ledge.

* * * * *